US007407059B2

(12) United States Patent
Sullivan et al.

(10) Patent No.: US 7,407,059 B2
(45) Date of Patent: Aug. 5, 2008

(54) DRYING STORAGE RACK

(75) Inventors: Ann Sullivan, Waltham, MA (US); Allan Cameron, Natick, MA (US); Patrick F. McDormott, Oxford, MA (US); Paul Gregory, Cambridge, MA (US); Guerav Rohatgi, Franklin, MA (US); Zach Traina, Hingham, MA (US); Dean DiPietro, Brooklyn, NY (US)

(73) Assignee: Helen of Troy Limited, St. Michael (BB)

( * ) Notice: Subject to any disclaimer, the term of this patent is extended or adjusted under 35 U.S.C. 154(b) by 91 days.

(21) Appl. No.: 11/302,301

(22) Filed: Dec. 13, 2005

(65) Prior Publication Data

US 2007/0131629 A1 Jun. 14, 2007

(51) Int. Cl.
*A47G 19/08* (2006.01)

(52) U.S. Cl. ..... 211/41.03; 32/3; 220/572

(58) Field of Classification Search ..... 211/41.2–41.8, 211/126.9, 133.5, 133.6, 181.1; D32/3, 55–59; 220/487–488, 572
See application file for complete search history.

(56) References Cited

U.S. PATENT DOCUMENTS

| | | | | |
|---|---|---|---|---|
| 222,542 | A | 12/1879 | Steams | |
| 542,912 | A | 7/1895 | Wood | |
| 777,211 | A | 12/1904 | Jones | |
| 815,855 | A | 3/1906 | McAdams | |
| 990,454 | A | 4/1911 | Peters | |
| 1,822,087 | A | 9/1931 | Feingold | |
| 1,835,535 | A | 12/1931 | Stocker | |
| 1,908,128 | A | 5/1933 | De Bie | |
| 2,479,118 | A * | 8/1949 | Jenness | 211/41.5 |
| 2,516,088 | A | 7/1950 | Einhorn | |
| 2,655,267 | A | 10/1953 | Planeta | |
| 2,708,037 | A | 5/1955 | Planeta | |
| 2,749,939 | A | 6/1956 | Bray | |
| 2,936,898 | A | 5/1960 | Miguez | |
| D247,416 | S | 3/1978 | Berman et al. | |
| 4,221,299 | A | 9/1980 | Taylor | |
| 4,328,899 | A | 5/1982 | Krusche | |
| D271,339 | S | 11/1983 | Lee | |
| 5,136,736 | A | 8/1992 | Bishop | |
| 5,184,749 | A | 2/1993 | Attenasio | |
| 5,480,035 | A * | 1/1996 | Smith | 211/41.8 |
| 5,794,797 | A | 8/1998 | Kuntz | |
| 5,853,581 | A | 12/1998 | Rayborn et al. | |
| D423,160 | S | 4/2000 | Lenney | |
| 6,170,676 | B1 | 1/2001 | Patadia et al. | |
| 6,179,134 | B1 | 1/2001 | Pine et al. | |
| 6,357,605 | B1 * | 3/2002 | Martorella | 211/41.6 |

(Continued)

*Primary Examiner*—Brian E. Glessner
*Assistant Examiner*—Candace L. Bradford
(74) *Attorney, Agent, or Firm*—Seyfarth Shaw LLP

(57) ABSTRACT

A storage rack for retaining items to be dried, which can be used in conjunction with a drain basin, such as a sink, or as a stand alone system is disclosed. The rack includes a support body having a bottom surface, a plurality of side surfaces, and a plurality of foot members extending from the body in a direction opposite the side surfaces. The rack also includes three detachable basins: two side basins and a lower drain basin. The lower basin includes a flexible spout extending beyond an edge, the spout being capable of movement between a downward position extending below the surface of the basin and an upward position extending the spout above the surface of the basin.

15 Claims, 8 Drawing Sheets

U.S. PATENT DOCUMENTS 6,502,704 B2 * 1/2003 Martorella et al. ..... 211/41.6
6,516,956 B2 * 2/2003 Martorella et al. ..... 211/41.6
D490,198 S * 5/2004 Jerstroem et al. ..... D32/55
6,763,954 B1 * 7/2004 Travers et al. ..... 211/41.3
D534,701 S * 1/2007 Schmidt ..... D32/55
2004/0144738 A1 7/2004 Sampaio

* cited by examiner

DRYING STORAGE RACK

TECHNICAL FIELD

The present invention relates to a rack for storing utensils, such as, for example, plates, bowls, pots, pans, flatware, and the like, for drying. More specifically, the present invention relates to a drying rack having multiple detachable basins for storing such utensils.

BACKGROUND OF THE INVENTION

As long as there has been kitchens, there has been dirty dishes. As long as there has been dirty dishes, there has been a need to wash and dry such dishes. There are basically two widely accepted methods for accomplishing this least favorite task of most every person—i.e., washing and drying by hand or by use of an automatic dishwasher. For those still employing the former method, hand drying has typically been considered inferior to air drying. However, air drying requires the wet dishes to be exposed to the air for some time to allow water to be drained or evaporated.

Countless attempts have been made to provide a device which meets the many structural requirements as well as aesthetic desires for a drying rack, commonly referred to as a dish rack. Such requirements include the ability to accommodate various plate, bowl and glassware sizes, the ability to store a significant amount of dishes, including flatware, for drying, the ability to prevent messy water drainage onto counters, and the ability to provide easy compact storage when not in use while still being readily constructed when needed.

However, until the present device, none have addressed each of these problems with a single drying rack. The shortcomings of prior devices may be due to a perception that a larger dish rack would be too bulky or flimsy if it were made to be foldable. Or, perhaps it is a failure to recognize the failings of any particular device. Nonetheless, the present invention is unique in that it addresses each of these, as well as other problems found in the prior art. By providing a drying storage rack which is sturdy, capable of accommodating a variety of items, suitable for use as a stand alone rack as well as for use with a drain sink, and foldable for storage purposes, the present invention solves these problems.

SUMMARY OF THE INVENTION

There is disclosed herein an improved drying storage rack which avoids the disadvantages of prior racks while affording additional structural and operating advantages.

In an embodiment there is provided a drying rack comprising a support body, a first detachable basin, a second detachable basin, and a third detachable basin. The support body includes a bottom surface, a plurality of side surfaces attached substantially perpendicular to and along an edge of the bottom surface, and a plurality of foot members extending from the body in a direction opposite the side surfaces. The first detachable basin includes a substantially planar surface defined by a peripheral raised edge, and a flexible spout extending beyond an edge, the spout being capable of movement between a downward position extending below the planar surface of the basin and an upward position extending above the planar surface of the basin, wherein the basin is maintained in an elevated position by the foot members of the support body parallel to the bottom surface with the spout oriented below a side surface. The second detachable basin is preferably configured to be affixed to the support body and extend between two side surfaces, while the third detachable basin is also configured to be affixed to the support body and extend between two side surfaces.

It is an object of the present invention to provide an improved drying rack for storing a plurality of items for drying.

It is, therefore, another object of the invention to provide a drying rack with a bottom surface of the support body having three distinct zones created by a plurality of curved planar members defining a first zone, a plurality of raised members defining a second zone, and a plurality of straight planar members defining a third zone.

It is an object of one embodiment of the invention to provide a drying rack having side surfaces hinged to an edge of the bottom surface and capable of being folded when the detachable basins are removed.

A utensil comprising a handle portion composed of a rigid material, a blade portion connected to the handle portion having first and second surfaces and composed of a first flexible material, and a second flexible material adhered to at least one of either the first and second opposing surfaces of the blade portion is disclosed.

These and other objects of the invention will become apparent from the detailed description below and the appended drawing figures.

DETAILED DESCRIPTION OF THE INVENTION

Figure 1:
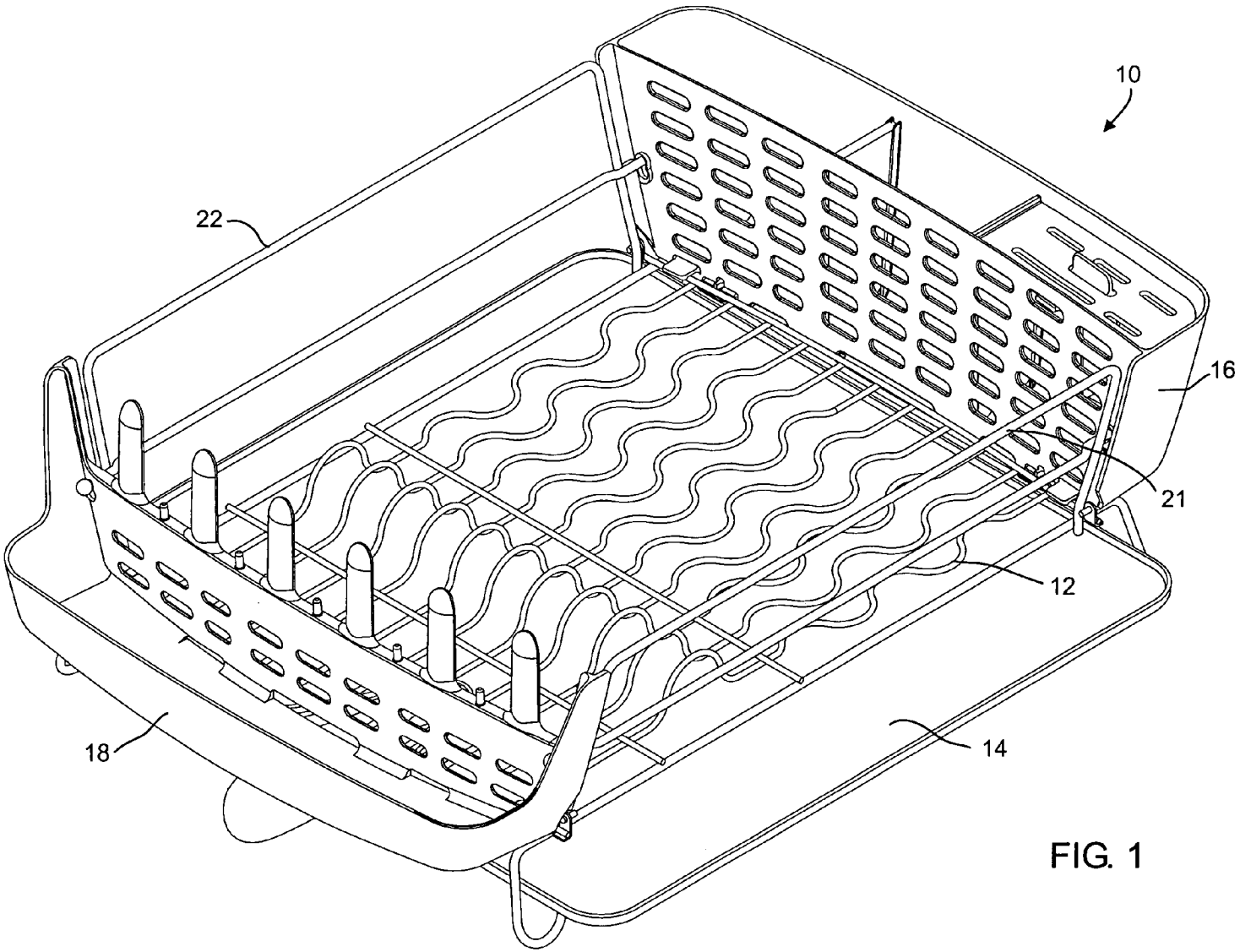
FIG. 1 is a perspective view of an embodiment of the drying storage rack of the present invention.

While the invention is susceptible of embodiment in many different forms, this disclosure will describe in detail preferred embodiments of the invention with the understanding that the present disclosure is to be considered as an exemplification of the principles of the invention and is not intended to limit the broad aspect of the invention to the embodiments illustrated.

Referring to the appended FIGS. 1-14, the following discussion references component 10 as a drying storage rack or merely as rack 10. In the illustrated embodiment, the drying storage rack 10 includes a support body 12, a first detachable basin 14, a second detachable basin 16, and a third detachable basin 18.

Figure 2:
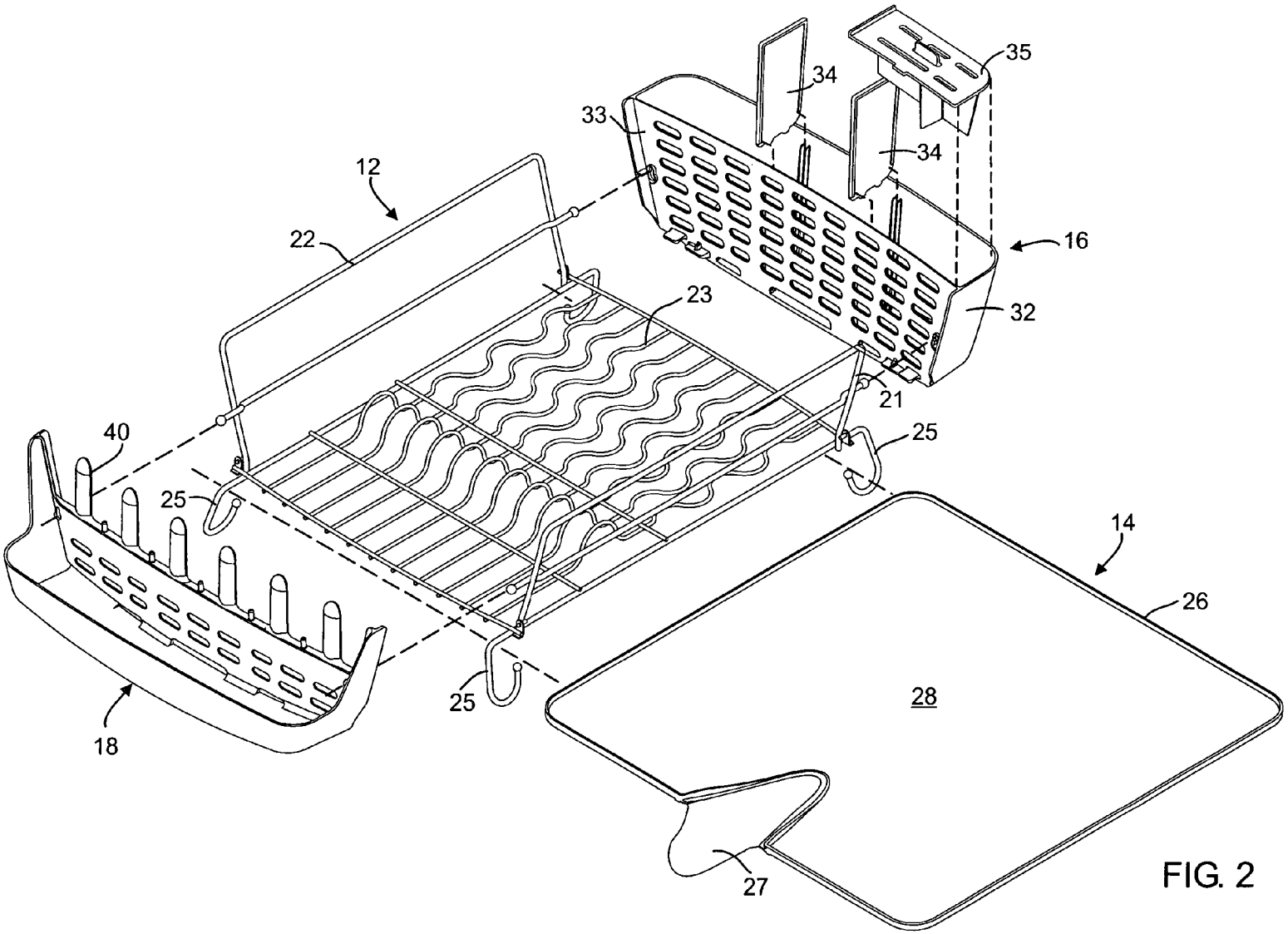
FIG. 2 is an exploded view of the drying storage rack illustrated in FIG. 1.
Figure 3:
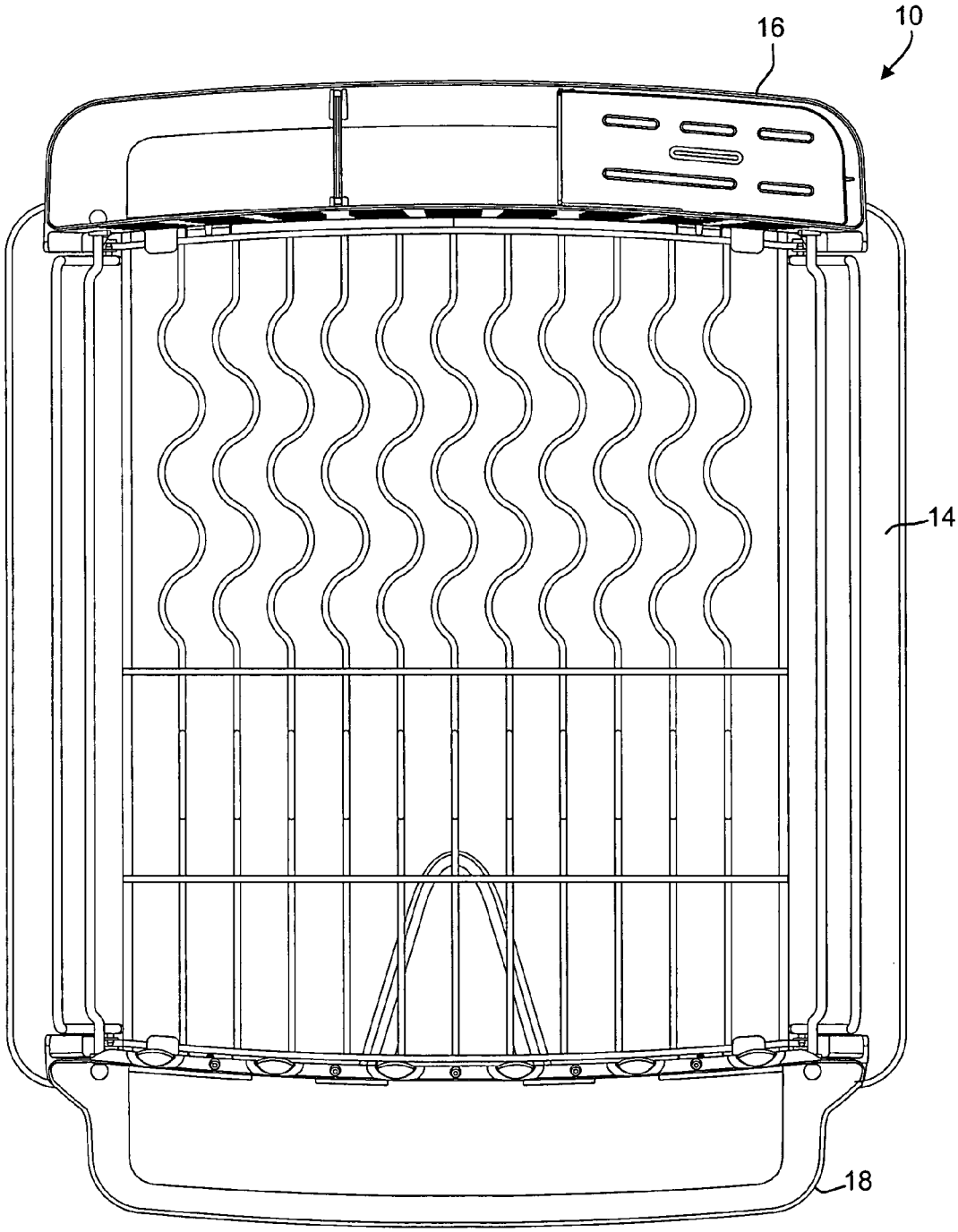
FIG. 3 is a top view of the drying storage rack illustrated in FIG. 1.
Figure 6:
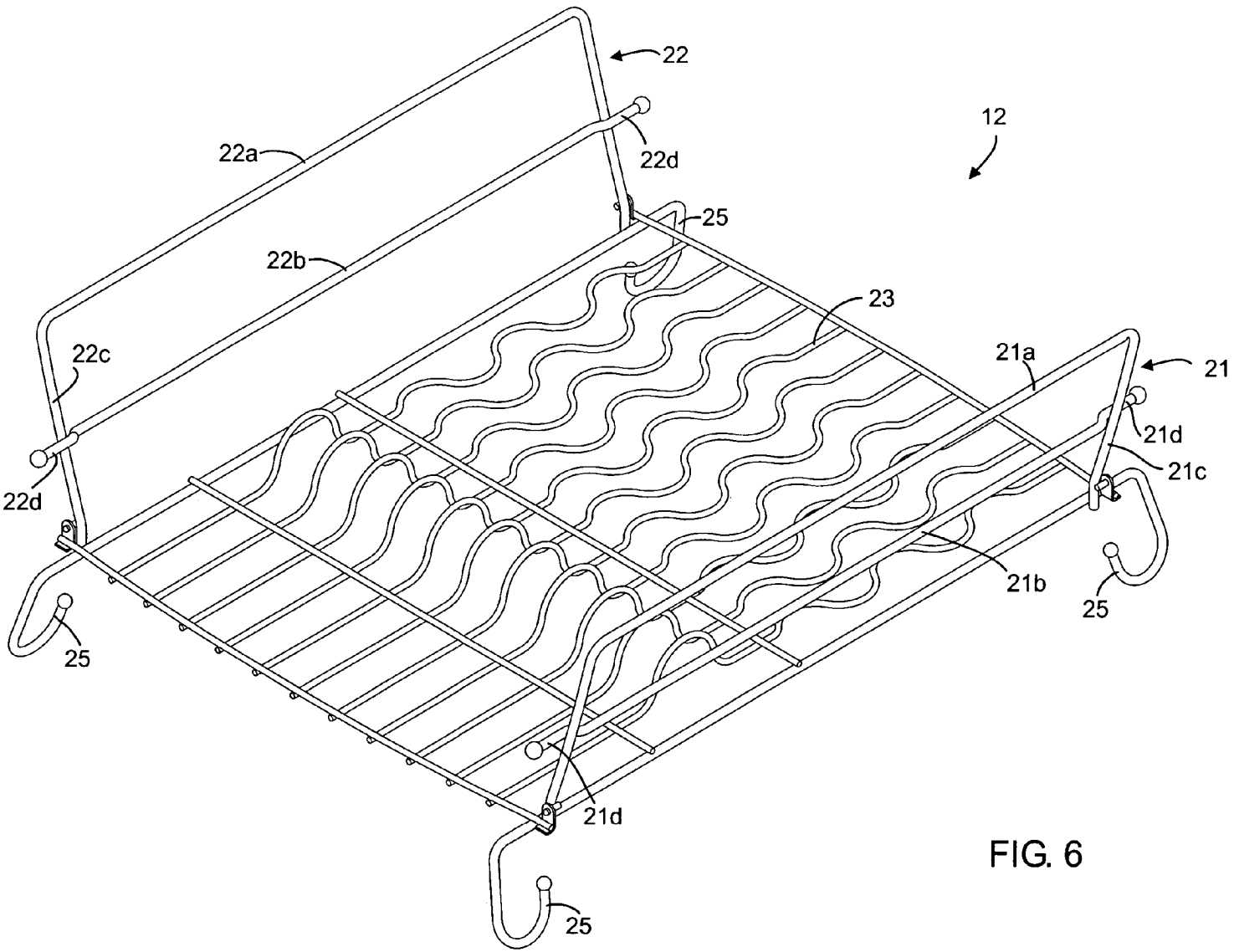
FIG. 6 is perspective view of an embodiment of the support body of the drying storage rack illustrated in FIG. 1.

The support body 12, with particular reference to FIGS. 1, 2 and 6, is constructed substantially of a coated wire frame in the present embodiment. The body 12 includes two foldable side surfaces 21, 22, connected by at least one hinge member, and preferably two hinge members each, to opposite edges of a bottom surface 23, and two open basin areas 24 adjacent each side surface. In an alternative embodiment, the two foldable side surfaces may be adjacent each other relative to the bottom surface 23. The support body 12 also includes a plurality of foot members 25, preferably four foot members, extending from the bottom surface 23 in a hook configuration. As discussed further below, the foot members 25, while supporting body 12, also serve to support the first detachable basin 14 in an elevated position (see FIG. 4).

The side surfaces 21, 22 can be of any configuration suitable for providing structural support to retain the detachable basins on the support body 12 and support for any drying items which may lean against the side surfaces. In the embodiment shown in FIG. 6, the side surfaces 21, 22 are each comprised, respectively, of a top rail 21*a*, 22*a*, a mid-rail 21*b*, 22*b* and two side rails 21*c*, 22*d*, which are curved extensions of the top rail 21*a*, 22*a*. Each mid-rail 21*b*, 22*b* includes a connecting member 21*d*, 22*d* extending from each end, as detailed in FIG. 6. The connecting members 21*d*, 22*d* include enlarged ends used for connecting the side surfaces 21, 22 to the adjacent basins 16 and 18, as discussed further below.

The side surfaces 21, 22 are designed to fold inward to lay across the bottom surface 23 when not is use. Accordingly, as illustrated in FIG. 6, each side surface 21, 22 is affixed to the bottom surface by two hinge components 39 attached proximate the end of each side rail 21*c*, 22*c*. The ends of each side rail 21*c*, 22*c*, are designed to form a stop biasing against the edge of the bottom surface 23 when the side surfaces 21, 22 are upright.

Referring now to FIGS. 2, 4, 5 and 11-14, the first detachable basin 14 can be more readily understood. The basin 14 is defined by a peripheral edge 26 about a planar surface 28. The edge 26 is preferably raised from the planar surface 28 a distance which is tall enough to provide a barrier against fluid running off the planar surface 28 at any point. A small portion of the edge 26 is not raised to accommodate a flexible spout 27 positioned to extend from the planar surface 28 beyond the basin edge 26. In an upward position, depicted by solid line of FIGS. 12 and 14, the spout 27, in combination with the peripheral edge 26, is capable of holding a quantity of fluid on the planar surface 28 of the basin 14. In a downward position, depicted by broken line of FIGS. 12 and 14, fluid is readily drained from basin 14 (see FIG. 1A). The basin 14 is preferably square to allow it to be positioned a number of ways below the bottom surface 23 of the support body 12. This allows the drying storage rack 10 to be positioned in a more convenient manner while still allowing the flexible spout 27 to be more easily aligned with a drain basin, when desired. Certainly, the basin may be made in a number of different geometric shapes, if desired.

Referring now to FIGS. 2, 4 and 7-10, the second detachable basin 16 is illustrated. The second basin 16 is preferably comprised of a compartment defined by a first wall segment 32 being curved at each end to connect to a second wall segment 33. The second wall segment includes a plurality of openings to allow a drying air flow to assist the drying process. The basin compartment preferably comprises at least one slidably removable panel, and preferably two removable panels 34, which connect to each of the first and second wall segments 32, 33. The removable panels 34 divide the compartment into sub-compartments, preferably three, to maintain items separate where desired.

Figure 8:
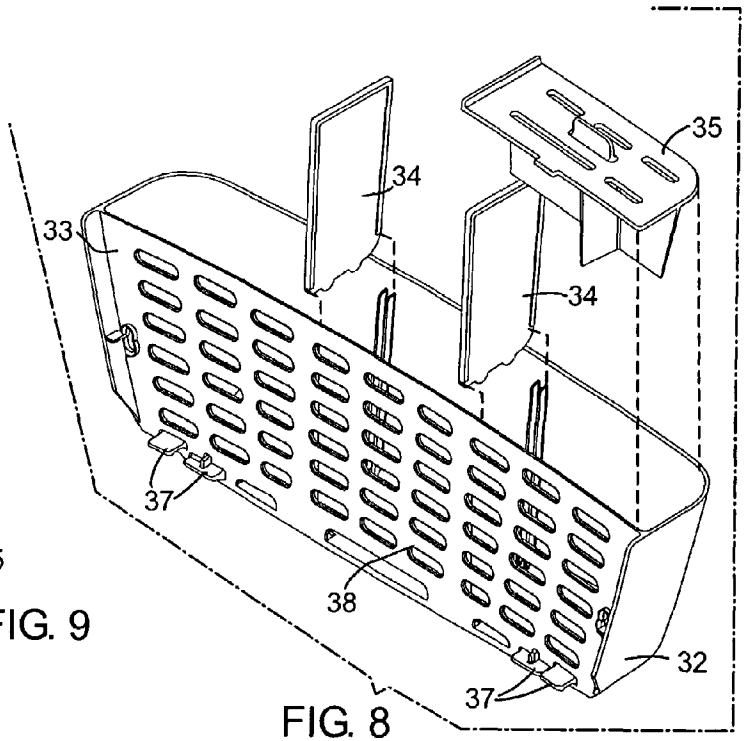
FIG. 8 is an exploded view of the detachable basin shown in FIG. 7.
Figure 7:
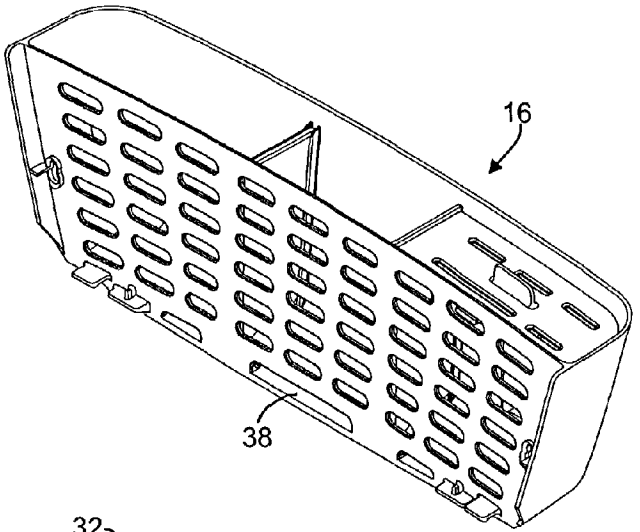
FIG. 7 is a perspective view of an embodiment of one of the detachable basins of the present drying storage rack.
Figure 9:
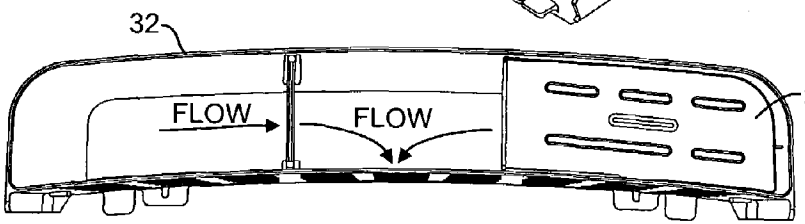
FIG. 9 is a top view of the detachable basin shown in FIG. 7.

At least one sub-compartment panel 35 may be used with the basin 16, as shown in FIG. 8. The sub-compartment panel 35 is configured to cover an upper opening of a sub-compartment and includes a plurality of slotted openings therein to accommodate articles to be held in a vertical position for drying (see FIG. 1A).

The second wall segment 33 of the basin 16 also includes at least one connecting aperture 36 for engaging a corresponding connecting member 21*d*, 22*d* on a side surface 21, 22 of the support body 12. The connecting aperture 36 preferably comprises a rounded first portion and a slotted second portion to lock the connecting members in place. Accordingly, the rounded first portion should have a diameter greater than the diameter of the enlarged end of the connecting member 21*d*, 22*d* and the slotted second portion should have a maximum diameter less than the diameter of the enlarged end of the connecting member 21*d*, 22*d*.

Locking tabs 37 complete the connection of the detachable basin 16 by positioning one tab on each side of an edge of the bottom surface 23. The locking tabs 37 provide vertical stability to the basin 16, helping to keep it from being accidentally knocked off the rack 10. Alternatively, positive engaging mechanisms, such as c-clips (not shown) or the like may be used to connect the basin 16 to the edge of bottom surface 23.

Figure 4:
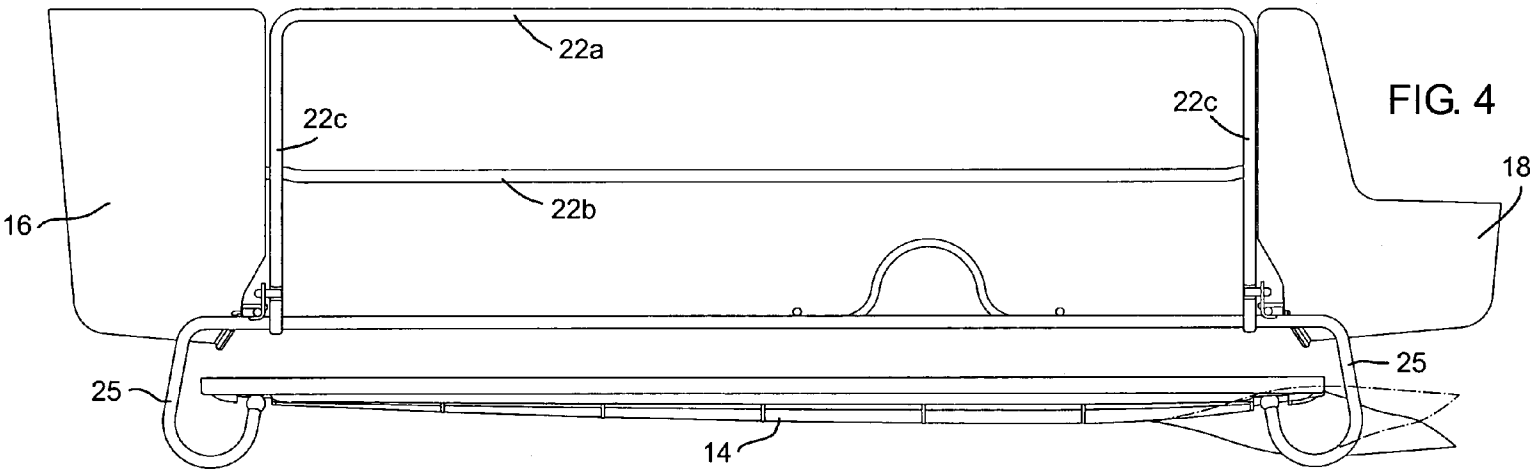
FIG. 4 is an elevated side view of the drying storage rack illustrated in FIG. 1.
Figure 5:
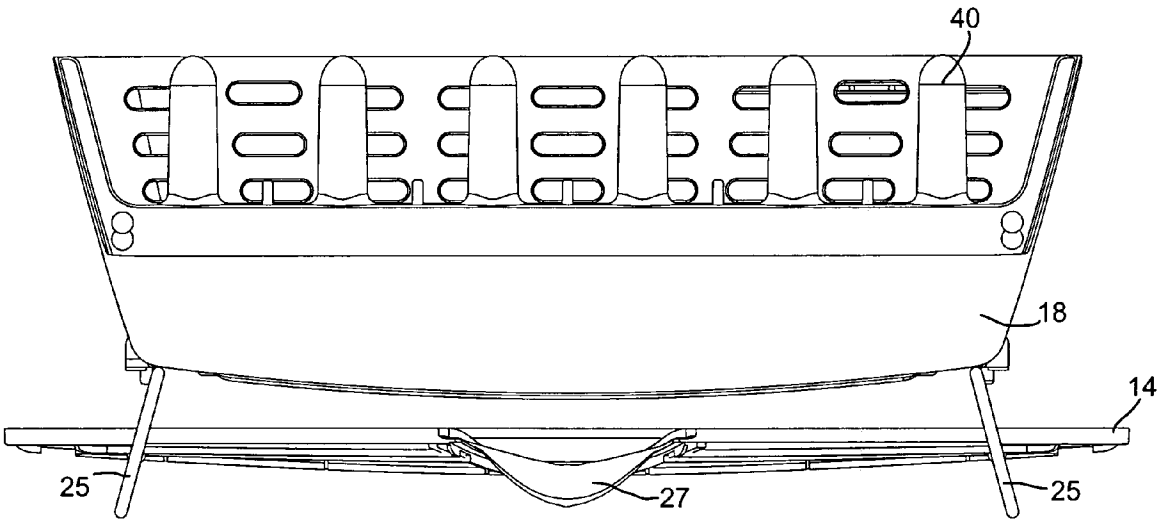
FIG. 5 is an elevated front view of the drying storage rack illustrated in FIG. 1.
Figure 10:
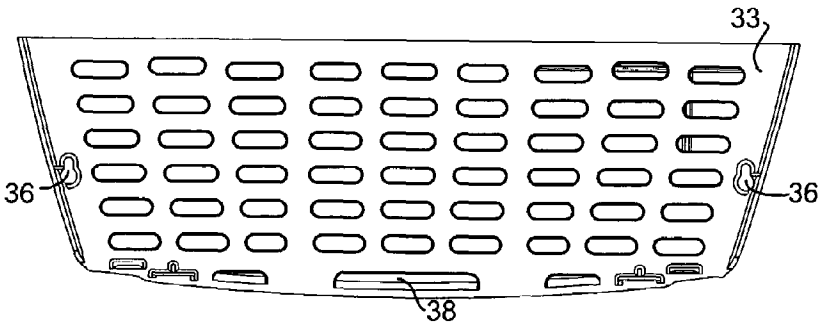
FIG. 10 is a side view of the detachable basin shown in FIG. 7.
Figures 11, 12, 13, 14:
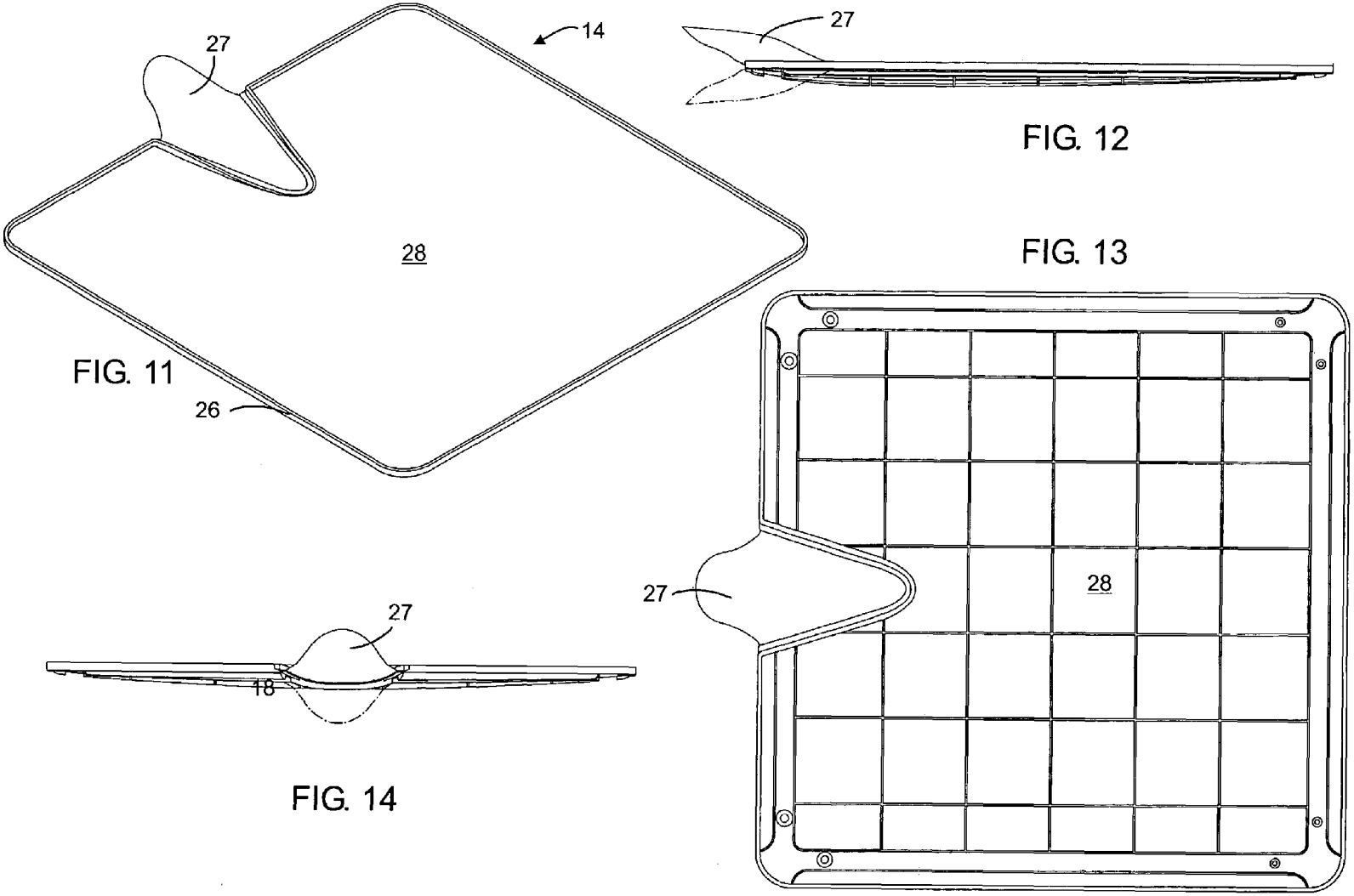
FIG. 11 is a perspective view of an embodiment of another of the detachable basins of the present invention.
FIG. 12 is an elevated side view of the detachable basin illustrated in FIG. 11.
FIG. 13 is a bottom view of the detachable basin illustrated in FIG. 11.
FIG. 14 is a front view of the detachable basin illustrated in FIG. 11 showing an embodiment of the flexible spout in an upward position and a downward position (broken lines).

The floor of the basin compartment is preferably pitched toward the second wall segment 33 where a drain hole 38 is provided, as best shown in FIG. 10. The drain hole 38 allows water that is funneled by the sloped floor to be drained from the compartment and onto the first detachable basin 14. Accordingly, the drain hole 38 should be positioned above the first detachable basin 14, as shown in FIG. 4. The second basin 16 is supported on an upper portion of the foot members 25 of the support body 12, as also shown in FIG. 4.

Returning to FIG. 1, the third detachable basin 18 can be seen. The third basin 18 is similar in construction to the second basin 16 as far as how it is connected to the support body 12. The third basin 18, however, has a different compartment configuration. Many different compartment variations are considered possible and fall within the intended scope of the present application.

Figure 1A:
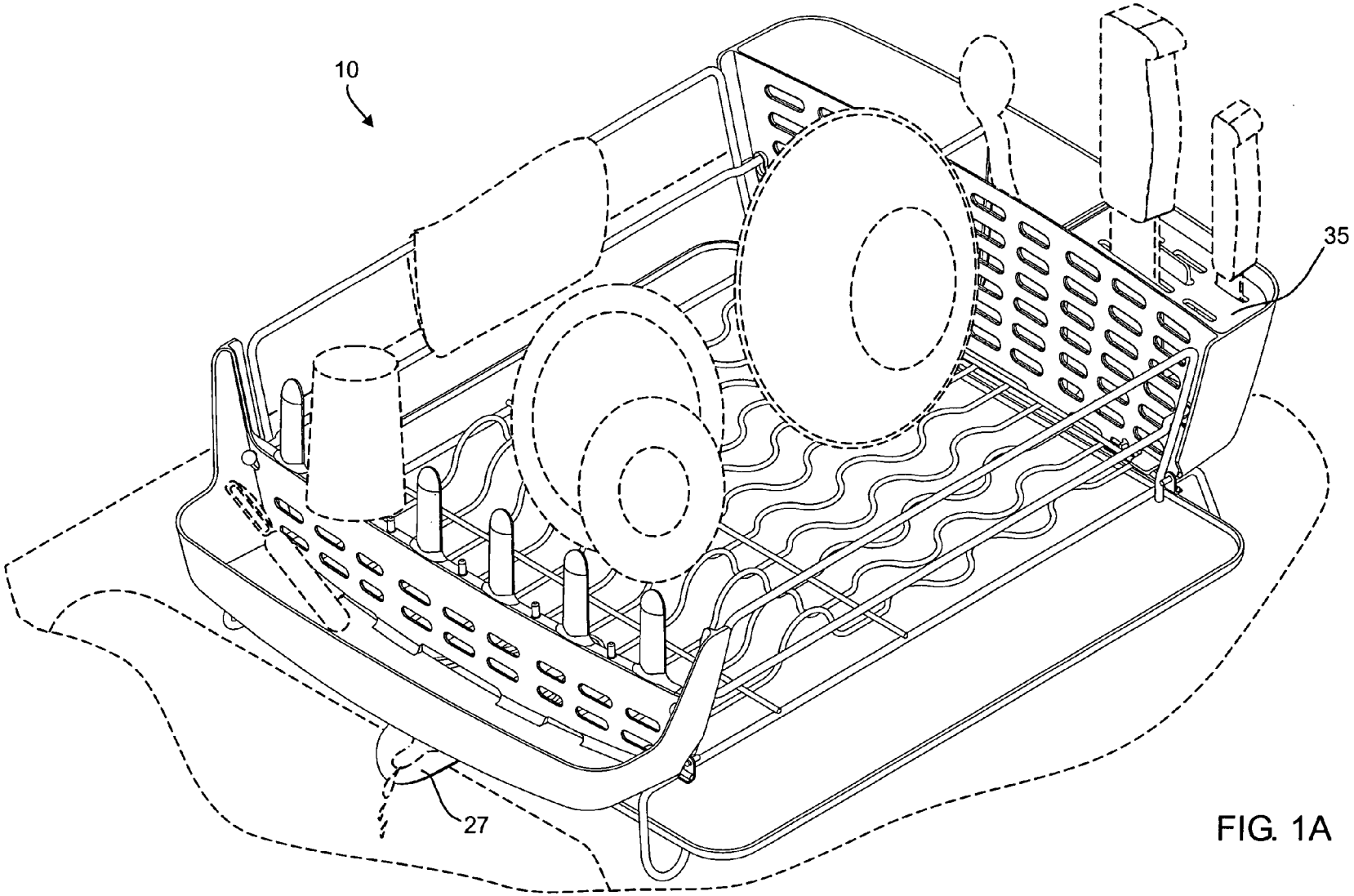
FIG. 1A is a perspective view of the drying storage rack of FIG. 1 in use.

Preferably, basin 18 comprises a shallow compartment with a plurality of finger-like projections 40 along a top span of an inner-wall. As shown in FIG. 1A, the shallow compartment can be used for the drying storage of irregular-shaped objects, while the finger-like projections 40 may be used to support cups, bottles, and the like.

The third detachable basin 18 also comprises a pitched floor which directs water out a drain hole 38 on the inner-wall. The third basin 18 is also supported on the support body 12 by upper portions of the foot members 25 much like the second basin 16.

In use, with reference to FIGS. 1A and 2, rack 10 is first constructed by raising the side surfaces 21, 22 on the support body 12. One of either the second or third detachable basin 16 or 18, respectively, is then connected to the side surfaces 21, 22 at an open basin area 24 by inserting the enlarged ends of connecting members 21*d* and 22*d* into the round portion of the corresponding connecting apertures 36 in the second wall segment 33. The connecting members 21*d* and 22*d* are then slid into the slot portion of the connecting apertures 36. The locking tabs 37 then engage the edge of the bottom surface 23 for added stability of the basin 16. This procedure is then repeated with the remaining of the two detachable basin.

Thereafter, the first detachable basin 14 can then be placed beneath the support body 12, resting in an elevated position on the ends of foot members 25. The basin 14 may be positioned such that the flexible spout 27 is extending from along any of the four sides of the rack 10. If the rack is being used next to a drain basin, such as a sink, the flexible spout 27 can be placed in a downward position to empty any collecting water from the stored items. When rack 10 is used as a stand alone drying storage rack, the flexible spout 27 is preferably positioned upward to retain any draining water.

While specific embodiments have been illustrated and described, numerous modifications are possible without departing from the spirit of the invention, and the scope of protection is only limited by the scope of the accompanying claims.

What is claimed is:

1. A drying storage rack comprising:

a support body having two side surfaces, a bottom surface and a plurality of foot members extending from the body, the support body being open along at least one edge of the bottom surface to define a basin area extending between two opposing side surfaces, each of the opposing side surfaces having at least one connecting member extending toward the basin area, and wherein at least one of either a second basin and a third basin comprises at least one connecting aperture for engaging a corresponding connecting member on a side surface of the support body, wherein the at least one connecting member comprises an enlarged end having a diameter and the at least one connecting aperture comprises a rounded first position and a slotted second portion, the rounded first portion having a diameter greater than the diameter of the enlarged end and the slotted second portion having a maximum diameter less than the diameter of the enlarged end; and a first detachable basis having a substantially planar surface defined by a peripheral raised edge, and a flexible spout extending beyond an edge, the spout being capable of movement between a downward position extending below the planar surface of the basin and an upward position extending above the planar surface of the basin, wherein the basin is maintained in an elevated position by the foot members of the support body parallel to the bottom surface.

2. The drying storage rack of claim 1, wherein the bottom surface of the support body is comprised of three distinct zones created by a plurality of curved planar members defining a first zone, a plurality of raised members defining a second zone, and a zone of straight planar members.

3. The drying storage rack of claim 1, further comprising a plurality of side surfaces attached to the bottom surface, wherein the side surfaces of the support body are hinged to an edge of the bottom surface and are capable of being folded when the detachable basins are removed.

4. The drying storage rack of claim 1, wherein:

the second basin is detachable and configured to be affixed to the support body and extend between two side surfaces; and the third basin is detachable and configured to be affixed to the support body and extend between two side surfaces;

wherein the second and third detachable basins each comprises a sloped bottom surface converging at an opening positioned above the first detachable basin when the basins are affixed to the support body.

5. The drying storage rack of claim 1, wherein the first basin is shaped to allow the spout to be oriented below any side of the bottom surface.

6. The drying storage rack of claim 5, wherein the first basin is square.

7. The drying storage rack of claim 1, wherein the support body has two basin areas opposite each other, and both the second basin and the third basin comprise at least one connecting aperture for engaging a corresponding connecting member on a side surface of the support body.

8. The drying storage rack of claim 4, wherein the second basin comprises a compartment defined by a first wall segment being curved at each end to connect to a second wall segment having a plurality of drain openings, and wherein the compartment comprises at least one slidably removable panel which connect to each of the first and second wall segments to divide the compartment into at least two sub-compartments.

9. The drying storage rack of claim 4, wherein the second basin further comprises at least one sub-compartment panel configured to cover an upper opening of a sub-compartment and having a plurality of slotted openings therein to accommodate articles to be held in a vertical position for drying.

10. A drying storage rack comprising;

a support body comprising:

a bottom surface including three distinct zones created by a plurality of curved planar members defining a first zone, a plurality of raised members defining a second zone, and a zone of straight planar members, two side surfaces attached substantially perpendicular to and along an edge of the bottom surface, the support body being open along at least one edge of the bottom surface to define a basin area extending between two opposing side surfaces, each of the opposing side surfaces having at least one connecting member extending toward the basin area, and a plurality of foot members extending from the body in adirection opposite the side surfaces;

a first detachable basin having a substantially planar surface, defined by a peripheral raised edge, and having a flexible spout extending beyond an edge, the spout being capable of movement between a downward position extending below the planar surface of the basin and an upward position extending above the planar surface of the basin, the first basin being maintained man elevated position by the foot members of the support body parallel to the bottom surface with the spout oriented below a side surface;

a second detachable basin having a sloped bottom surface converging at an opening positioned above the first detachable basin and configured to be affixed to the support body and extend between two side surfaces; and a third detachable basin having a sloped bottom surface converging at an opening positioned above the first detachable basin and configured to be affixed to the support body and extend between two side surfaces, wherein at least one of either the second basin and the third basin comprises at least one connecting aperture for engaging a corresponding connecting member on a side surface of the support body.

11. The drying storage rack of claim 10, wherein the first basin is square.

12. The drying storage rack of claim 10, wherein the at least one connecting member comprises an enlarged end having a diameter and the at least one connecting aperture comprises arounded first portion and a slotted second portion, the rounded first portion having a diameter greater than the diameter of the enlarged end and the slotted second portion having a maximum diameter less than the diameter of the enlarged end.

13. The drying storage rack of claim 10, wherein the support body has two basin areas opposite each other, and both the second basin and the third basin comprise at least one connecting aperture for engaging a corresponding connecting member on a side surface of the support body.

14. The drying storage rack of claim 10, wherein the second basin comprises a compartment defined by a first wall segment being curved at each end to connect to a second wall segment having a plurality of drain openings, and wherein the compartment comprises at least one slidably removable panel which connect to each of the first and second wall segments to divide the compartment into at least two sub-compartments.

15. The drying storage rack of claim 10, wherein the second basin further comprises at least one sub-compartment panel configured to cover an upper opening of a sub-compartment and having a plurality of slotted openings therein to accommodate articles to be held in a vertical position for drying.

* * * * *

UNITED STATES PATENT AND TRADEMARK OFFICE

CERTIFICATE OF CORRECTION

PATENT NO. : 7,407,059 B2
APPLICATION NO. : 11/302301
DATED : August 5, 2008
INVENTOR(S) : Ann Sullivan et al.

It is certified that error appears in the above-identified patent and that said Letters Patent is hereby corrected as shown below:

Column 6

Claim 10; line 39 "adirection" should be --a direction--.

Column 6

Claim 10; line 46 "man" should be --in an--.

Column 6

Claim 12; line 67 "arounded" should be --a rounded--.

Signed and Sealed this

Thirtieth Day of September, 2008

JON W. DUDAS
*Director of the United States Patent and Trademark Office*